US008882382B2

(12) United States Patent
Coupard et al.

(10) Patent No.: US 8,882,382 B2
(45) Date of Patent: Nov. 11, 2014

(54) DEVICE FOR APPLYING EPILATION WAX WITH PRECISION

(75) Inventors: Giles Coupard, Meudon (FR); Virginie Fera, Cergy (FR)

(73) Assignee: Church & Dwight Co., Inc., Princeton, NJ (US)

( * ) Notice: Subject to any disclaimer, the term of this patent is extended or adjusted under 35 U.S.C. 154(b) by 0 days.

(21) Appl. No.: 13/994,496

(22) PCT Filed: Dec. 12, 2011

(86) PCT No.: PCT/US2011/064322

§ 371 (c)(1),
(2), (4) Date: Jun. 14, 2013

(87) PCT Pub. No.: WO2012/082579

PCT Pub. Date: Jun. 21, 2012

(65) Prior Publication Data

US 2013/0287473 A1 Oct. 31, 2013

(30) Foreign Application Priority Data

Dec. 16, 2010 (FR) ..... 10 60625

(51) Int. Cl.

| | |
|---|---|
| ***B05C 17/02*** | (2006.01) |
| ***B05C 17/035*** | (2006.01) |
| ***A45D 40/26*** | (2006.01) |
| ***A45D 26/00*** | (2006.01) |

(52) U.S. Cl.
CPC ..... *A45D 40/261* (2013.01); *B05C 17/0357* (2013.01); *A45D 26/0014* (2013.01)
USPC ..... 401/219; 401/208

(58) Field of Classification Search
CPC ..... B05C 17/0355; B05C 17/035; B05C 17/0357; B05C 17/02; B05C 17/0217; A45D 34/0412
USPC ..... 401/208, 218–220
See application file for complete search history.

(56) References Cited

U.S. PATENT DOCUMENTS

| | | | | |
|---|---|---|---|---|
| 3,263,265 | A * | 8/1966 | Judson | 401/269 |
| 4,958,951 | A | 9/1990 | Mann | |
| 7,628,559 | B2 * | 12/2009 | Petit | 401/219 |
| 2003/0002912 | A1 * | 1/2003 | Morpeth | 401/220 |

FOREIGN PATENT DOCUMENTS

| | | |
|---|---|---|
| EP | 499318 | 8/1992 |

* cited by examiner

*Primary Examiner* — David Walczak
(74) *Attorney, Agent, or Firm* — Fishman & Asociates, LLC

(57) ABSTRACT

A device for applying epilation wax, allowing for a precise application from the stand-point of thickness as well as dimensions of the application, comprising a body (10) containing wax, a head comprising an open housing provided with longitudinal and transverse lateral walls, the housing receiving a movable applicator (28) mounted in rotation in the housing, characterized in that the movable applicator (28) is a wheel (50) whose lateral surfaces (54-1 and 54-2) are domed.

8 Claims, 3 Drawing Sheets

DEVICE FOR APPLYING EPILATION WAX WITH PRECISION

CROSS-REFERENCE TO RELATED APPLICATION

This application is related to French Patent Application Ser. No. 10 60625 filed Dec. 16, 2010 and takes priority therefrom.

FIELD OF THE INVENTION

The present invention relates to a device for applying epilation wax, allowing for a precise application from the standpoint of thickness as well as dimensions of the application.

BACKGROUND OF THE INVENTION

Wax dispensers which are constituted of a head mounted on a flexible container are known. The container ensures the containment of the wax and the head ensures the distribution of the wax thus stored in the container.

The wax generally used is adapted to be made more fluid by a temperature increase. This fluidity is limited so as to enable an application of the wax in a thin layer, but without running, while also ensuring a sufficient wettability vis-à-vis the hairs and/or fine hairs to be removed. When cooling, the wax imprisons the hairs. The wax is adapted not to adhere to the skin. The wax thus deposited then only has to be removed by traction to ensure the hairs imprisoned within the wax are pulled out.

To facilitate this pulling operation, it is possible to lay a small strip of mesh or non-woven material on the laid out wax, immediately after application, when the latter is still sticky and has a "tacking" power, so the small strip is also imprisoned in the cooling wax matrix, becoming affixed to this small strip. A traction on the strip facilitates grasping and makes pulling out the wax/hairs assembly including the hairs possible.

Waxes are presently of a different nature, based on synthesis polymers. More and more, these new waxes are based on natural, sugar-based polymers. The advantages of these waxes are numerous. First, these waxes use sugars which are known to originate from agricultural products and are thus renewable. In addition, these products are naturally biodegradable, and require no recycling. The cleaning is carried out with water, and therefore without necessitating any sort of solvent and without generating any waste.

However, there still remains the problem of the wax application and practicality of this operation. This wax application and removal operation must indeed be simple, fast, precise, without requiring skill, and, most importantly, with no risk to the user. Another constraint is cleaning the device since the device must be reusable after a first use in a simple and fast manner without requiring complex cleaning or disassembly.

The device according to the invention not only targets the above objections, but, also targets other industrial objectives: simplicity of fabrication to limit costs, increased affordability of the device, a limited number of pieces to facilitate its assembly and its automation on a conveyor, and durable and reliable functioning, without blockages.

DETAILED DESCRIPTION OF THE INVENTION

The device according to the present invention will now be described in detail according to a particular, non-limiting embodiment; this description being made with reference to the annexed drawings.

Figure 1:
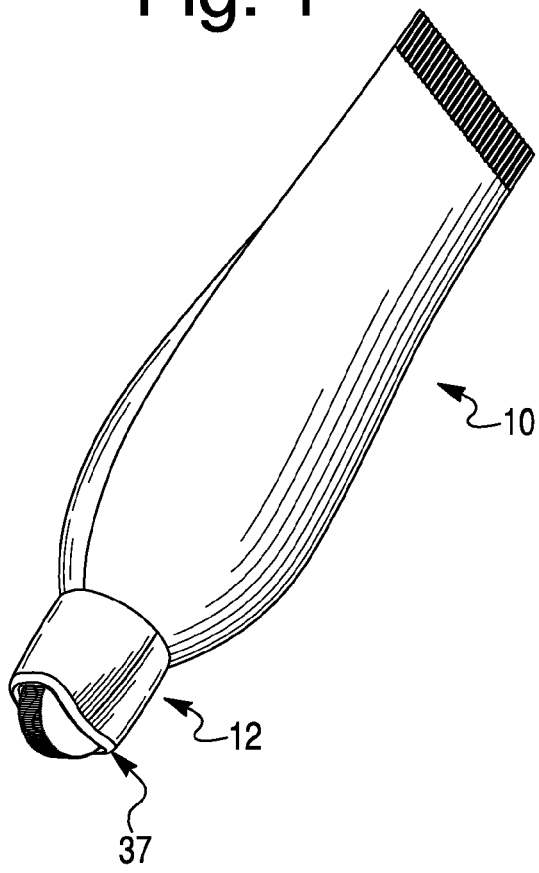
FIG. 1: a perspective view of the device according to the present invention, in an application state.
Figure 2:
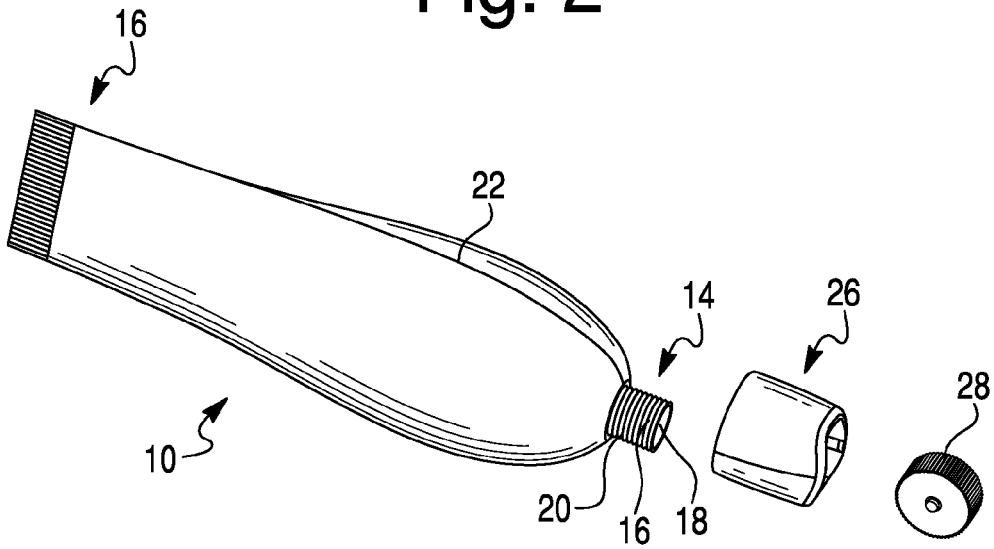
FIG. 2: an exploded, perspective view of the device according to the present invention.

FIG. 1 shows a complete device for applying wax according to the invention. This device comprises a body 10 and an applicator head 12 attached to said body. This body 10 is made in a known manner out of plastic. The shape is obtained by extrusion blow molding, for example. A preform or parison made of plastic material is placed in a mold and the body is formed by molding, possibly by blowing air under pressure. In this case, the body 10 has a substantially cylindrical shape with upper 14 and lower 16 ends, FIG. 2. This hollow body 10 comprises an open neck 18 placing the inner volume of the body 10 out in the open, this open neck being provided with an outer screw thread 20, as shown in FIG. 2, located on a shoulder 22, constituting the upper end 14 of the body 10.

The lower end 16 remains opened after being removed from the mold so as to enable the filling of the device according to the invention with the product to be dispensed, epilation wax in the present case. The filling is carried out with a covering of said open neck 18 with a conventional cap, the applicator head 12 being made separately and mounted immediately before use, in lieu of the cap.

Once the body has been filled, this body 10 is sealed at the lower end 16 by flattening followed by border to border welding, constituting a segment substantially equal to the diameter of the body before flattening, measured perpendicular to this end. The body 10 can have a different shape than that illustrated, the drawn shape having, however, satisfactory design and ergonomics while providing a suitable capacity. The nature of the plastic material used is compatible with the wax which it contains so that, on the one hand, the wax does not adhere and, on the other hand, it allows the wax to be placed at the temperature of use, as explained later.

Figure 3:
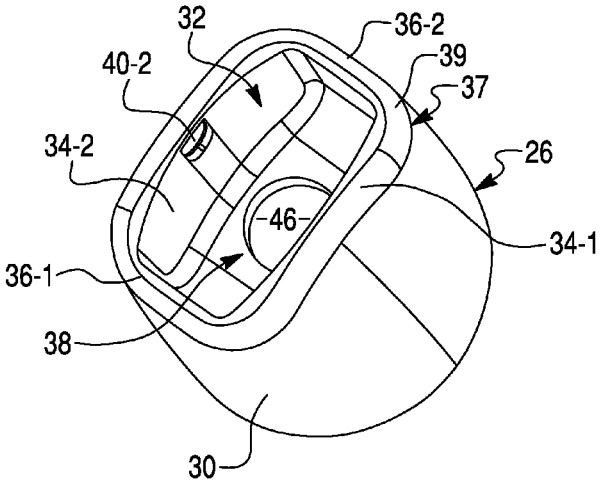
FIG. 3: a top, perspective view, providing details of the application head.
Figure 4:
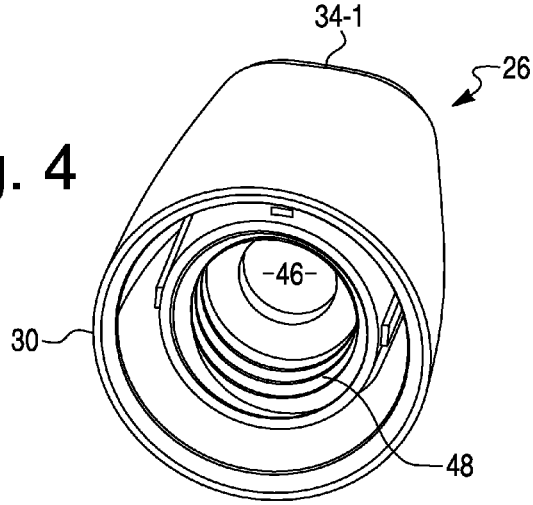
FIG. 4: a bottom, perspective view, providing details of the application head.
Figure 5:
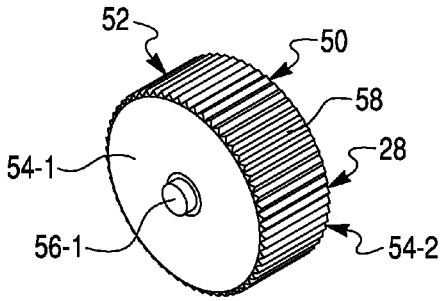
FIG. 5: a detailed view of the movable applicator.

The head 12 is composed of two pieces, shown in detail in FIGS. 3, 4, and 5, namely a base 26 and a movable applicator 28. The base 26 in FIGS. 3 and 4 comprises a peripheral envelope 30 with an open housing 32 having a substantially rectangular shape. The housing 32 thus comprises two longitudinal lateral surfaces 34-1 and 34-2 and two transverse lateral surfaces 36-1 and 36-2 and a bottom 38. The longitudinal lateral surfaces 34-1 and 34-2 each have an arc-shaped upper border with a large radius of curvature, whereas the two transverse lateral surfaces 36-1 and 36-2 have rectilinear borders.

Figure 6:
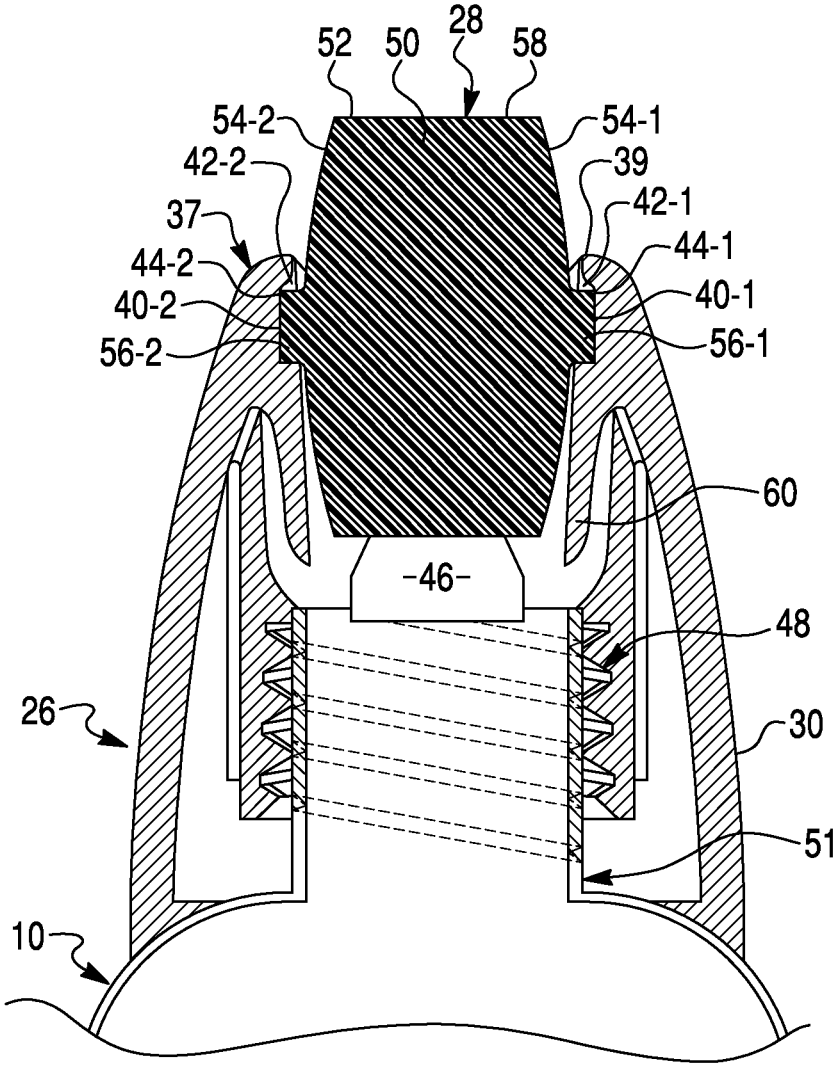
FIG. 6: a cross-sectional detailed view of the head screwed on the body of the device.

Generally, the edge 37 of these 4 borders is rounded and the angles also have a curvature in order to avoid any harm to the skin during application as will be explained later. Each of the longitudinal lateral surfaces 34-1 and 34-2 is provided, perpendicular to the apex of the arch, with a groove 40-1 and 40-2 (FIG. 6), open toward the free border of each of the surfaces and closed toward the inside of the housing, the shape being semi-circular. Each groove 40-1 and 40-2 bears, immediately perpendicular to the border of said longitudinal lateral surface 34-1 and 34-2, a lip 42-1 and 42-2, having a triangular section, with a slope oriented toward the bottom 38 of the housing, facilitating the insertion and blocking the removal. Thus, each groove 40-1 and 40-2 is delimited to form a bearing 44-1 and 44-2. The bottom 38 of the housing is flat with a channel perpendicular to the angles between said bottom and the transverse and longitudinal lateral surfaces.

The bottom 38 bears at its center a hole 46 for communication between the body 10 and the open housing 32. Under the bottom 38, as shown in detail in FIG. 6 also, a skirt 51 is provided comprising a screw thread 48, produced by molding, adapted to cooperate in a sealed manner with the external screw head 20 of the open neck 18.

The movable applicator 28 is a wheel 50 comprising a peripheral rolling surface 52 and two domed surfaces 54-1 and 54-2. This wheel 50 is provided with two cylindrical tabs 56-1 and 56-2 projecting perpendicularly to the rotation axis, forming a rotating shaft, arranged on both sides of the median plane. These tabs 56-1 and 56-2 have a shape adapted to cooperate in rotation with the bearings 44-1 and 44-2 of the longitudinal lateral walls 34-1 and 34-2 provided to receive them. The surface 52 for peripheral rolling of the wheel 50 comprises transverse grooves 58 having a sinusoidal cross-section, if the succession of grooves on the periphery in the median plane is considered. The depth of these grooves depends on the properties of the wax at application temperature as will be explained later.

Therefore, assembling the head is simple since the wheel 50 is inserted in the open housing 32, the tabs 56-1 and 56-2 are in abutment on the lips 42-1 and 42-2 and an additional pressure causes the passage of the tabs beyond the lips to lodge themselves by ratcheting in bearings 44-1 and 44-2. The tabs are thus maintained in these bearings and are free in rotation. The base 26 bearing the movable applicator 28 can thus be screwed on the body 10. The three pieces are thus assembled to form the device according to the invention shown in FIG. 1.

The device according to the invention is filled with a suitable wax, particularly, but not exclusively, sugar-based. To use it, the body 10 of the device is placed in a water bath, for example, or in any other hot water container with a conventional cap, the cap being advantageously oriented downward. The applicator head 12 is mounted only at the time of use. The first advantage is to dissolve the possible wax drippings resulting from a previous use. In parallel, the volume of wax contained is heated to the temperature suited to its application.

It then suffices to unscrew the conventional cap to mount the applicator head by screwing and placing the wheel in contact with the skin on the area to be epilated, and then roll the wheel by translational displacement while maintaining pressure to deposit the wax on the desired area. The wheel ensures the dosage at the same time as the spreading. Indeed, placing the wheel 50 in rotation makes it possible to circulate the wax coming from the body 10 which passes through the hole 46 to come out in the space situated between the wheel and the bottom 38. The wheel functions as a mini wheel with blades, the blades being the transverse grooves 58 which ensure the distribution of wax at a suitable volume.

Similarly, the grooves in contact with the wax applied onto the skin allow for latching which sets said wheel into rotation, regulating the thickness of the applied wax. It must be noted that the contours can be followed precisely since the transverse borders do not hinder the maneuvers. The longitudinal lateral borders, being substantially perpendicular to the rotational axis of the wheel 50 are not a hindrance either. The wheel 50 is thus clear over more than half its circumference, which makes it very accessible. It must be noted that the wheel 50 rotates freely by creating in the open housing 32 a passage adapted for the wax to be expelled via the hole 46. It must also be noted that the domed surfaces 54-1 and 54-2 prevent the wax from exiting the space created between one or the other of the lateral transverse surfaces 36-1 and 36-2 and the peripheral rolling surface 52 of the wheel, according to the displacement direction of the device. This allows a very precise, even dosing, with no gaps, proportional to the translational movement and thus proportional to the length of application.

In order to feed the wheel to dose the quantity of wax, a slight pressure must be exerted on the flexible body 10. It must be noted here also that even if the exerted pressure is accidentally substantial, the volume distributed cannot be substantial since the static flow is very limited since the wheel must rotate to free the necessary applicable volume. At the end of use, the applicator head 12 is disassembled, then rinsed for a future application and the body 10 receives the conventional cap again to ensure the remaining volume of wax is preserved.

During the next use, the device is again ready to be put back in service by proceeding with the same steps as those carried out during the first use.

The invention claimed is:

1. Device for applying epilation wax, allowing for a precise application from the standpoint of thickness as well as dimensions of the application, comprising a body (10) containing said wax, a head (12), said head comprising an open housing (32) provided with longitudinal (34-1 and 34-2) and transverse (36-1 and 36-2) lateral surfaces, said housing receiving a movable applicator (28) mounted in rotation in said housing, characterized in that said movable applicator (28) is a wheel (50) whose lateral surfaces (54-1 and 54-2) are domed, wherein said longitudinal lateral surfaces are longer than said transverse lateral surfaces, each of said longitudinal lateral surfaces (34-1 and 34-2) has an arc-shaped upper border that has a large radius of curvature, each of said two transverse lateral surfaces (36-1 and 36-2) has a rectilinear border, said arc-shaped upper borders are rectilinear borders have round edges (37), and said round edges (37) transition into surfaces (39) that are substantially parallel to a peripheral rolling surfaces (52) of said wheel (50).

2. Device for applying epilation wax according to claim 1, characterized in that the wheel comprises tabs (56-1 and 56-2) whose shape is adapted to cooperate in rotation with bearings (44-1 and 44-2) housed in the lateral longitudinal walls (34-1 and 34-2) of the open housing.

3. Device for applying epilation wax according to claim 2, characterized in that the bearings (44-1 and 44-2) are constituted of a groove (40-1 and 40-2) blocked by a lip (42-1 and 42-2) having a triangular section, with a slope oriented toward a bottom (38) of the housing, facilitating the insertion and blocking the removal.

4. Device for applying epilation wax according to any of the previous claims, characterized in that the wheel (50) comprises transverse grooves (58).

5. Device for applying epilation wax according to claim 4, characterized in that the grooves (58) of the wheel (50) have a sinusoidal cross-section, by considering the succession of these grooves in the median plane of said wheel (50).

6. Device for applying epilation wax according to claim 3, characterized in that the bottom (38) of the open housing comprises a hole (46) for communication between the internal volume of the body (10) and said open housing.

7. Device for applying epilation wax according to claim 1, characterized in that the bearings (44-1 and 44-2) are arranged perpendicularly to apexes of the arcs of the borders of the longitudinal lateral surfaces (34-1 and 34-2).

8. Device for applying epilation wax according to claim 1, characterized in that the wax is a sugar-based wax.

* * * * *